US006508533B2

(12) United States Patent
Tsujimoto et al.

(10) Patent No.: US 6,508,533 B2
(45) Date of Patent: Jan. 21, 2003

(54) INK-JET PRINTING APPARATUS AND RECOVERY PROCESSING METHOD OF EJECTION PORT

(75) Inventors: Akira Tsujimoto, Yokohama (JP); Junji Shimoda, Chigasaki (JP); Tadayoshi Inamoto, Hachioji (JP); Isao Kimura, Kawasaki (JP); Aya Yoshihira, Yokohama (JP); Kiyomitsu Kudo, Kawasaki (JP); Tooru Suzuki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 42 days.

(21) Appl. No.: 09/817,261

(22) Filed: Mar. 27, 2001

(65) Prior Publication Data

US 2001/0026299 A1 Oct. 4, 2001

(30) Foreign Application Priority Data

Mar. 28, 2000 (JP) ..... 2000-089654

(51) Int. Cl.[7] ..... B41J 2/165
(52) U.S. Cl. ..... 347/30; 347/29
(58) Field of Search ..... 347/30, 22, 29, 347/28, 31, 23, 32

(56) References Cited

U.S. PATENT DOCUMENTS

| | | | | |
|---|---|---|---|---|
| 4,313,124 | A | 1/1982 | Hara | 347/57 |
| 4,345,262 | A | 8/1982 | Shirato et al. | 347/10 |
| 4,459,600 | A | 7/1984 | Sato et al. | 347/47 |
| 4,463,359 | A | 7/1984 | Ayata et al. | 347/56 |
| 4,558,333 | A | 12/1985 | Sugitani et al. | 347/65 |
| 4,608,577 | A | 8/1986 | Hori | 347/66 |
| 4,723,129 | A | 2/1988 | Endo et al. | 347/56 |
| 4,740,796 | A | 4/1988 | Endo et al. | 347/56 |
| 4,947,191 | A | 8/1990 | Nozawa et al. | 347/30 |
| 5,471,230 | A | 11/1995 | Saito et al. | 347/29 |
| 5,733,055 | A | 3/1998 | Hiramatsu et al. | 400/355 |
| 6,123,408 | A | 9/2000 | Ishize et al. | 347/30 |

FOREIGN PATENT DOCUMENTS

| | | | | |
|---|---|---|---|---|
| EP | 0 785 072 | | 7/1997 | |
| JP | 54-56847 | | 5/1979 | |
| JP | 58-151049 | | 10/1983 | |
| JP | 59-123670 | | 7/1984 | |
| JP | 59-138461 | | 8/1984 | |
| JP | 60-71260 | | 4/1985 | |
| JP | 362342643 | A * | 10/1988 | 347/29 |
| JP | 405077433 | A * | 3/1993 | 347/29 |
| JP | 406099584 | A * | 4/1994 | 347/29 |
| JP | 6-344566 | | 12/1994 | |
| JP | 9-48125 | | 2/1997 | |
| JP | 9-254413 | | 9/1997 | |
| JP | 10-100451 | | 4/1998 | |

* cited by examiner

*Primary Examiner*—John Barlow
*Assistant Examiner*—Shih-Wen Hsieh
(74) *Attorney, Agent, or Firm*—Fitzpatrick, Cella, Harper & Scinto

(57) ABSTRACT

An ink-jet printing apparatus, a cap and an ejection recovery method can satisfactorily perform a recovery process for respective ejection openings having different ink flow resistances and permit down-sizing. The ink-jet printing apparatus includes a printing head having a plurality of ejection openings, a cap for covering the ejection opening face where a plurality of ejection openings of the printing head are formed, and a recovery unit for suctioning ink from the ejection openings covered by the cap. The ink-jet printing apparatus also includes a sealing member for sealing predetermined ejection openings among the plurality of ejection openings provided within the cap.

14 Claims, 8 Drawing Sheets

INK-JET PRINTING APPARATUS AND RECOVERY PROCESSING METHOD OF EJECTION PORT

This application is based on Patent application Ser. No. 2000-89654 filed Mar. 28, 2000 in Japan, the content of which is incorporated hereinto by reference.

BACKGROUND OF THE INVENTION

1. Field of the Invention

The present invention relates to an ink-jet printing apparatus, and a recovery processing method of an ejection port. More particularly, the invention relates to an ink-jet printing apparatus and a recovery processing method of an ejection port having a function for recovering or maintaining good ink ejection performance of a printing head.

2. Description of the Related Art

Associated with the proliferation of information processing equipment, printing apparatuses as peripheral equipment have also proliferated. Particularly, an ink-jet printing apparatus,which performs printing by ejecting ink droplets from a plurality of ejection openings provided in a printing head toward a printing medium, has rapidly proliferated because color printing can be performed easily. Furthermore, associated with a demand for down-sizing, there has been proposed a serial type ink-jet printing apparatus, which alternately repeats a printing operation of moving the printing head in a predetermined direction and ejecting ink droplets during movement of the printing head and a paper feeding operation for feeding the printing medium by a predetermined amount in a direction perpendicular to the motion direction of the printing head.

In such ink-jet printing apparatus, the printing head is frequently mounted on a carriage which can scan in a predetermined direction. In a case of full-color printing, each of the printing heads for respective colors of yellow, magenta, cyan and black is constructed by integrating an ejection opening array and an ink tank. Also, among the printing heads, there are some printing heads, in which only the ink tank is detachable.

On the other hand, as a color image can be easily processed by information processing equipment, there has been an increasing demand for an ink-jet printing apparatus that can readily print those images in full-color printing, with enhanced image quality. To meet the demand, there has been proposed an ink-jet printing apparatus in which high image quality is realized by printing multi-gradation levels of density using the following method.

For example, concerning magenta and cyan, two kinds of inks having mutually different densities, namely, high density ink and low density ink, are provided for dividing ink densities of image data into a greater number of gradation levels for performing printing with such high and low density inks. In the alternative, by switching the ink ejection amount to be ejected from the printing head using only one kind of ink for each color, depending upon the density of the image data, to perform printing with different sizes of dots on the printing medium can realize high gradation levels and high image quality.

Particularly, the method for increasing gradation levels by forming different sizes of dots on the printing medium by switching ink ejection amounts can restrict the number of ink tanks to be loaded. Therefore, such method is effective for down-sizing of ink tanks and down-sizing of the ink-jet printing apparatus.

The printing head switching the ink ejection amount has been disclosed in Japanese Patent Application Laid-open No. 9-254413(1997) and Japanese Patent Application Laid-Open No. 9-48125(1997). In the above-identified publications, it has been proposed to differentiate ejection amounts by arranging a plurality of rows of ejection openings on an ink ejection face and differentiating sizes of ejection openings per row of the ejection openings.

By performing a printing operation many times or by leaving the printing head inoperative for a long period, it is possible to cause variations in ejection amount and/or ejecting direction from the printing head nozzles due to deposition of dust and dirt around the ejection opening or plugging with ink of increased density. In the alternative, ink may be dried to make ejection unstable upon initiation of printing.

In order to prevent drying of ink or ejection failure, the ink-jet printing apparatus is provided with a cap for covering the ejection opening face while the printing head is not used, or is provided with means for performing preparatory ejection at a predetermined position out of the printing region. For example, in an ink-jet printing apparatus disclosed in Japanese Patent Application Laid-open No. 10-100451 (1998), a cap covering a plurality of ejection openings is provided.

On the other hand, in the case of the printing head, in which only the ink tank is detachable, when the old ink tank is removed, air may penetrate into an ink passage connecting the ink tank and the ejection opening, or air may penetrate around the ejection opening. Therefore, when the ink tank is exchanged with new ink tank, re-filling of the ink becomes necessary up to around the ejection opening. Therefore, upon exchanging the ink tank, the ejection opening face is covered with the cap to perform suction of the ink by a suction means with driving a pump.

Such recovery operation by the preparatory ejection means, suction means and so on are performed during a printing operation or a non-printing operation, or upon exchanging of the ink tank or the like.

FIGS. 8A and 8B are sections showing a printing head portion and recovery unit portion of the conventional ink-jet printing apparatus.

As shown in FIG. 8A, a printing head 83 is mounted on a head carriage frame 83*a* movably arranged on a pair of upper and lower guide members 82. The printing head 83 is provided with two ejection opening portions 83*b* and 83*c* projecting downwardly from the lower surface of the head carriage frame 83a, namely from a surface opposing the printing medium feeding passage, a black ink tank 83*d* and a color ink tank 83*e* arranged detachably on the head carriage frame 83*a*.

The ejection opening portions 83*b* and 83*c* are formed with a plurality of ejection openings, respectively. The ejection opening portion 83*b* ejects black ink supplied from the black ink tank 83*d* and the ejection opening portion 83*c* ejects three kinds of inks of cyan, magenta and yellow supplied from the color ink tank 83*e*.

It should be noted that the black ink ejection openings 83*f*, the yellow ink ejection openings 83*g*, the magenta ink ejection openings 83*h* and the cyan ink ejection openings 83*f* are provided in plural. However, for the purpose of illustration, only one ejection opening is illustrated.

The ink-jet printing apparatus feeds a printing medium by means of a not shown printing medium feeding member, reciprocally scans the printing head and ejects ink droplets from respective ejection openings to form a desired image on the printing medium.

As shown in FIG. 8B, a recovery unit 810 for providing recovery process for the printing head 83 is provided. To the recovery unit 810, caps 89*b* and 89*c* for covering the ejection openings 83*b* and 83*c* are provided. The caps 89*b* and 89*c* are connected to not shown pumps. The recovery unit 810 moves up and down to cover the ejection openings 83*b* and 83*c* with the caps 89*b* and 89*c* and performs suction recovery by the pumps.

A plurality of ejection openings are arranged on the ejection opening face of the printing head. Among the various ink-jet printing apparatuses, some of the ink-jet printing apparatuses have ejection openings that are not uniform size and rather differentiate per row of ejection openings to permit printing of an image at higher resolution. When a plurality of kinds of ejection openings of different shapes are present, the conventional ink-jet printing apparatus is provided with the caps in a number corresponding to shapes and kinds of the ejection openings, which requires a large space and hinders down-sizing of the overall apparatus. On the other hand, when an attempt is made to perform suction recovery for all the ejection openings with one cap, fluctuations in suction may result due to differences of flow resistance of the ink caused by the shape of the ejection openings.

More particularly, the row of the ejection openings having high flow resistance lacks ink suction force if the same suction force is applied in comparison with the row of the ejection openings having low flow resistance upon cap suction to make it impossible to effectively perform suction recovery. In order to perform suction for the row of the ejection openings having high flow resistance, a long period of suction operation is required, or the ink of increased viscosity plugging the ejection openings cannot be suctioned satisfactorily. On the other hand, from the row of the ejection openings having low flow resistance is suctioned an unnecessarily large amount of ink if the same suction process as that for the ejection openings having high flow resistance is performed, resulting in a waste of ink. Furthermore, excessive suction may cause retention of bubbles within the ejection opening to possibly make normal ink ejection impossible.

SUMMARY OF THE INVENTION

The present invention has been achieved for solving the problems in the prior art. Therefore, the present invention can provide an ink-jet printing apparatus and a recovery processing method of an ejection port which can satisfactorily perform a recovery process for respective ejection openings having different ink flow resistances and permit down-sizing.

According to one aspect of the present invention, an ink-jet printing apparatus including a printing head having a plurality of ejection openings and a cap covering the ejection opening face where a plurality of ejection openings of the printing head is arranged, and suction means suctioning ink from the ejection openings covered by the cap, comprises a sealing member being provided within the cap for sealing a portion of the plurality of ejection openings. In the ink-jet printing apparatus, when the of the plurality of ejection openings are sealed by the sealing member, an operation for suctioning ink from the ejection openings which are not sealed is performed by the suction means.

According to another aspect of the present invention, an ink-jet printing apparatus has a cap for covering an ejection opening face of a printing head in which a plurality of ejection openings are arranged, wherein the cap comprises a projecting lip portion surrounding a plurality of ejection openings when the cap covers the ejection opening face and a projecting portion formed inside surrounded by the lip portion and sealing a portion of the plurality of ejection openings, and wherein when the lip portion contacts with the ejection opening face at a predetermined position, the projecting portion seals the portion of ejection openings, and when the cap moves in a direction parallel to the ejection opening face to contact the ejection opening face at a position different from the predetermined position, the projecting portion does not seal the portion of ejection openings.

According to another aspect of the present invention, an ink-jet printing apparatus has a cap for covering an ejection opening face of a printing head in which a plurality of ejection openings are arranged, wherein the cap comprises a projecting lip portion surrounding a plurality of ejection openings when the cap covers the ejection opening face, a deformable lip portion formed at the projecting tip end of the lip portion, and a projecting portion formed inside surrounded by the lip portion and sealing a portion of the plurality of ejection openings, and wherein when the lip portion is applied with a predetermined contact force at a predetermined position to contact with the ejection opening face, the deformable lip portion is deformed and the projecting portion seals the portion of ejection openings, and when the lip portion is applied with a force less than the predetermined contact force at the predetermined position to contact with the ejection opening face, the deformable lip portion is not deformed and the projecting portion does not seal the portion of ejection openings.

According another aspect of the present invention, an ink-jet printing apparatus has a cap for covering an ejection opening face of an ink head in which a plurality of ejection openings are arranged, wherein the cap comprises a projecting lip portion surrounding a plurality of ejection openings when the cap covers the ejection opening face, a projecting portion formed inside surrounded by the lip portion and sealing a portion of the plurality of ejection openings, and a projecting portion actuating portion for moving the projecting portion for sealing the portion of ejection openings when a suction process of the ejection openings other than the portion of ejection openings is performed, and for moving the projecting portion for releasing the seal of the portion of ejection openings while the suction process of the portion of ejection openings is performed.

According to another aspect of the present invention, an ejection recovery processing method of an ejection port comprises a covering step of covering by a cap an ejection opening face on which is arranged a plurality of ejection openings, a sealing step of sealing a portion of the plurality of ejection openings by a sealing member provided within the cap, and a suction step of suctioning the ink from ejection openings not sealed by the sealing member in the sealing step.

By employing the above structure, upon covering the ejection opening face with the cap at the predetermined position, the projecting portion is contacted with the predetermined row of the ejection openings, such as the ejection openings having low flow resistance, to seal the predetermined row of the ejection openings. By performing suction in this condition, ink is suctioned from the row of the ejection openings other than the predetermined row of ejection openings. Then, after sufficiently suctioning the ink from the row of ejection openings other than the predetermined row of ejection openings, the cap is moved to release sealing by the projecting portion to effect suctioning. Then, ink is suctioned from the predetermined row of ejection openings. Thus, ink can be suctioned from all of the ejection openings in just proportion.

The above and other objects, effects, features and advantages of the present invention will become more apparent from the following description of embodiments thereof taken in conjunction with the accompanying drawings.

BRIEF DESCRIPTION OF THE DRAWINGS

FIGS. 5A to 5C are sections showing a state of contact between the cap and the ejection opening face, in which FIG. 5A shows a non-contacting condition, FIG. 5B shows a first recovery stage and FIG. 5C denotes a second recovery stage;

FIGS. 6A to 6C are sections showing a state of contact between another embodiment of the cap and the ejection opening face, in which FIG. 6A shows a non-contacting condition, FIG. 6B shows a first recovery stage and FIG. 6C denotes a second recovery stage;

FIGS. 7A and 7B are sections showing a state of contact between another embodiment of the cap and the ejection opening face, in which FIG. 7A shows first recovery stage and FIG. 7B denotes a second recovery stage; and FIGS. 8A and 8B are sections showing the conventional printing head portion and a recovery unit portion, in which FIG. 8A shows the printing head portion and FIG. 8B shows the recovery unit portion.

DETAILED DESCRIPTION OF PREFERRED EMBODIMENTS

Embodiments of the present invention will be discussed hereinafter with reference to the drawings.

Figure 1:
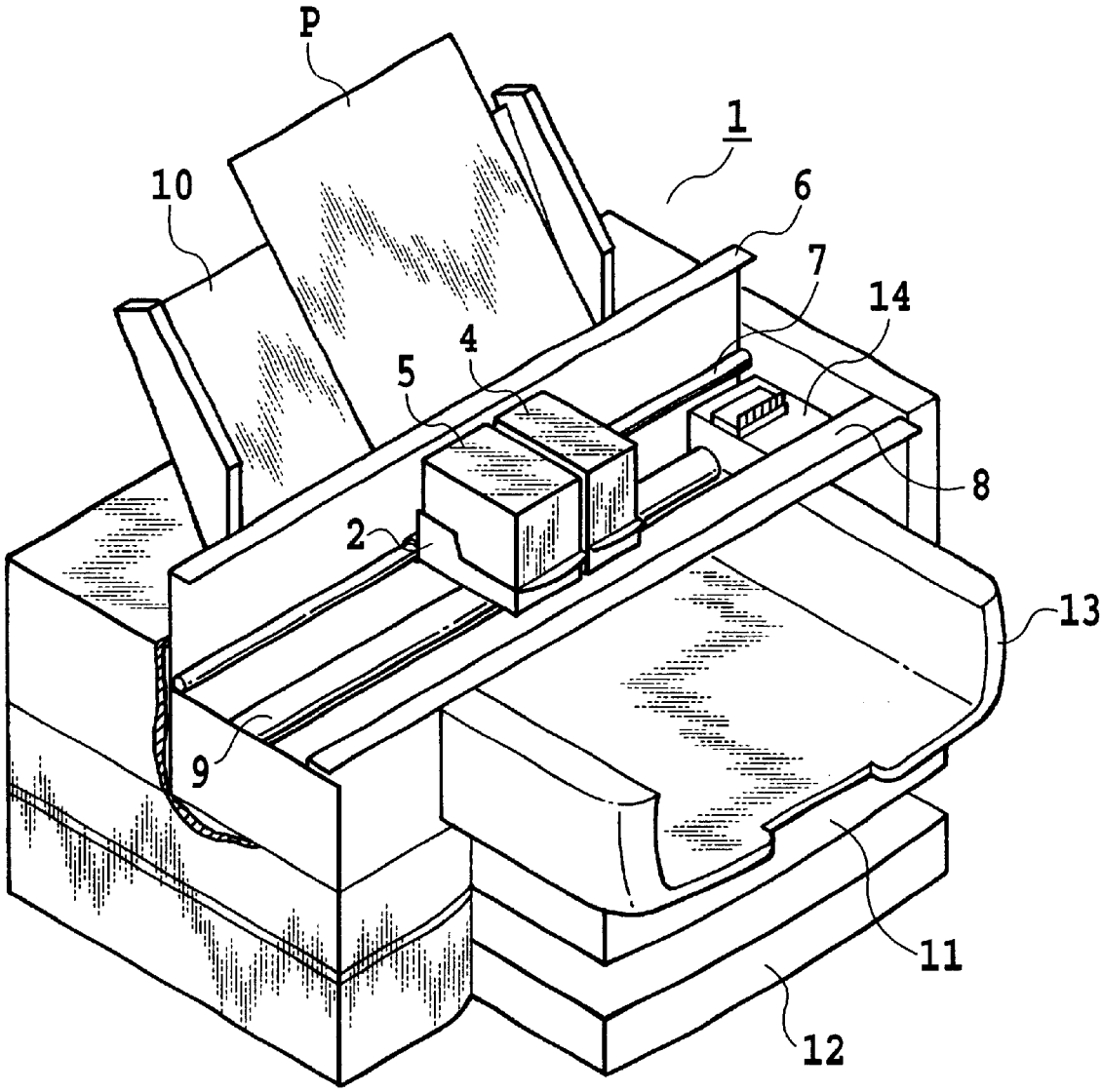
FIG. 1 is a perspective view of an ink-jet printing apparatus.

FIG. 1 is a perspective view of one embodiment of an ink-jet printing apparatus according to the present invention.

The ink-jet printing apparatus 1 has a carriage 2. On the carriage 2, a printing head (not shown), a black ink tank 4 storing a black ink, and a color ink tank 5 storing cyan, magenta and yellow inks are provided. The carriage 2 is fixed on a frame 6 at both end portions for movement along a guide shaft 7 and a guide rail 8 disposed in parallel to the frame 6. The carriage 2 is moved by a driving force of a carriage motor (not shown) transferred through a carriage belt (not shown). The carriage motor can be a stepping motor or the like.

On the other hand, a printing medium P stacked on an automatic sheet feeder 10 or upper cassette 11 and lower cassette 12 is fed by a paper feeding mechanism (not shown) and is fed to a predetermined print start position as pinched by the feeding roller 9 and a pinch roller (not shown). Then, the carriage 2 performs scanning. During scanning by the carriage 2, the printing head performs printing. When one path of scan is completed, the printing medium is fed for a predetermined amount in a direction perpendicular to the scanning direction of the carriage 2. By repeating the printing operation and feeding operation, printing over the entire printing medium can be performed.

On the other hand, the ink-jet printing apparatus 1 performs a recovery operation by a recovery mechanism 14 during standby of a command of printing or before and after the printing operation or at an appropriate timing during printing in order to recover performance or maintain good condition of the printing head. In the recovery mechanism, a cap, a suction pump, a wiping member and so on are provided. The construction and operation of the recovery mechanism will be explained later.

Figure 2:
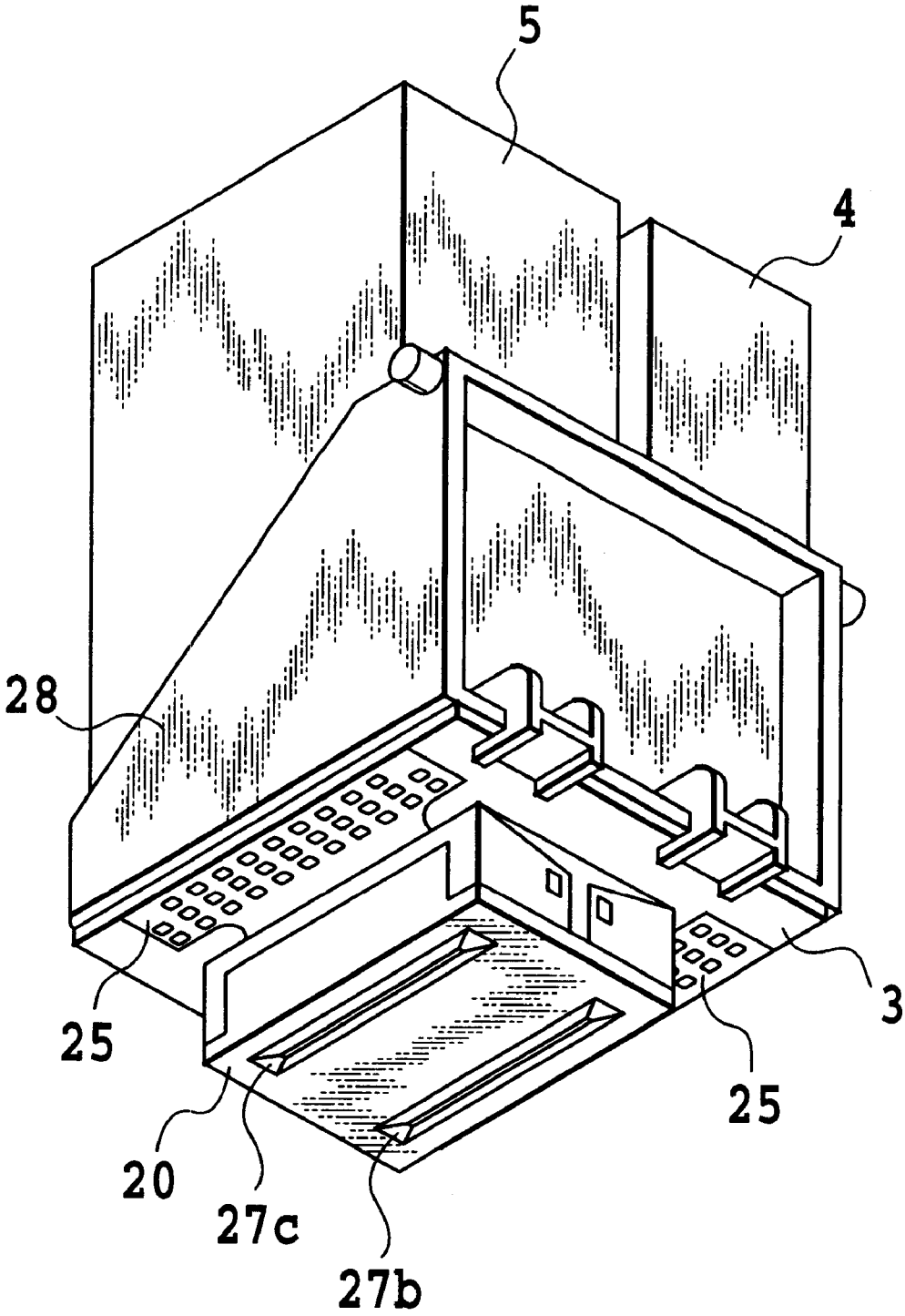
FIG. 2 is a perspective view of a printing head and an ink tank.

FIG. 2 is a perspective view of the printing head and the ink tank.

The printing head 3 is provided with ejection opening face 20 on the surface opposing the printing medium as loaded on the carriage, and is provided with rows of plural ejection openings 27*b* and 27*c* arranged on the ejection opening face. Each election opening is applied with an electrical signal necessary for ink ejection by an electrical circuit board 25. The electrical circuit board 25 contacts a predetermined position in a holder of the carriage when the printing head 3 is loaded on the carriage. The electrical signal is received from the contact point.

On the other hand, the black ink tank 4 and the color ink tank 5 are detachably loaded in a head holder 28. The ink of the black ink tank 4 is filled in each ejection opening of the row of the ejection openings 27*b* via an ink supply passage (not shown). Similarly, each ink of cyan, magenta, and yellow of the color ink tank 5 is also filled in each ejection opening of the row of ejection openings 27*c* via the ink supply passage.

Figure 3:
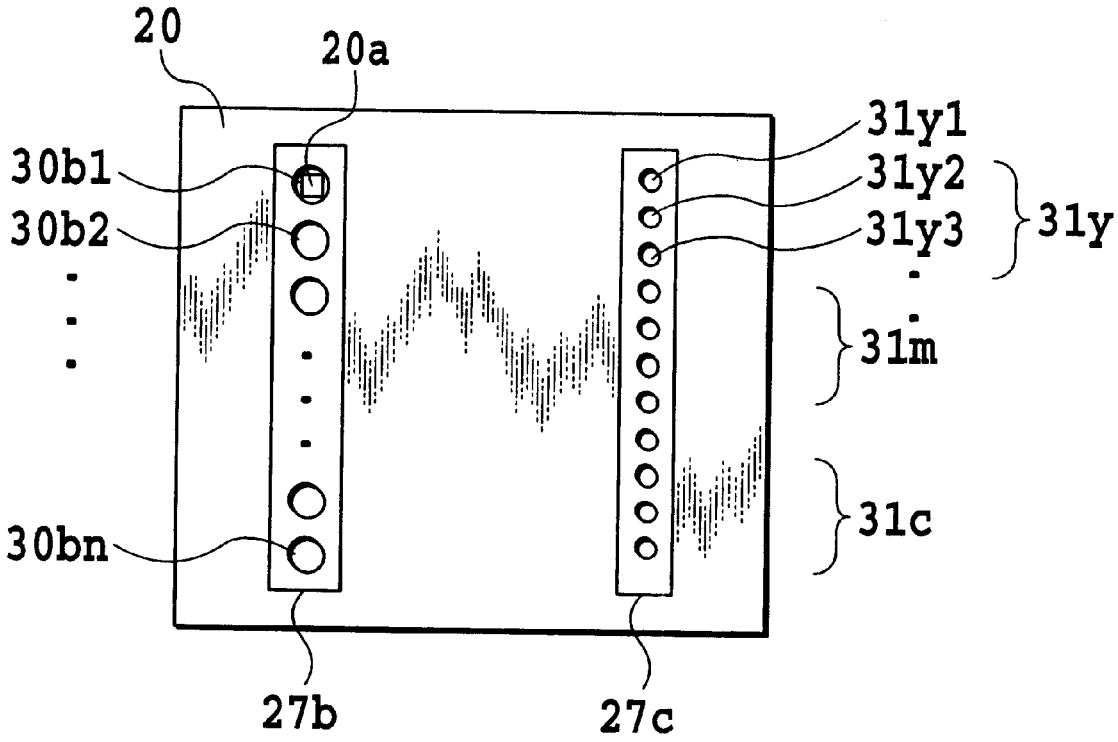
FIG. 3 is a diagrammatic illustration showing an ejection opening face.

FIG. 3 is a diagrammatic illustration showing the ejection opening face.

In the row of the ejection openings 27*b* ejecting the black ink, n in number of ejection openings 30*b*1, 30*b*2, . . . 30*bn* are arranged in alignment. The size of each ejection opening 30 is 22 $\mu$m×22 $\mu$m. From each ejection opening 30, an ink passage (not shown) is extended. Each ink passage is communicated with an ink chamber (not shown). The ink of the black ink tank is filled up to each ejection opening via the ink chamber from the ink supply passage. Furthermore, in each ink passage, a heater 20*a* is provided corresponding to each ejection opening 30. In FIG. 3, only the heater corresponding to ejection opening 30*b*1 is illustrated. In order to eject the ink, the heater is heated to generate a bubble in the ink. Then, by generation of pressure from the bubble, a predetermined amount of ink in the form of a droplet is ejected. In the shown embodiment, the heater size is 26'32 $\mu m^2$ and the ejection amount is $8\times10^{-15}$ $m^3$ (8 pl).

The row of the ejection openings 27*c* ejecting respective colors of color inks is divided per n in number for each ink color. Ejection openings 31*y*1 . . . 31*yn* for ejecting the yellow ink, the ejection openings 31*m*1 . . . 31*mn* for ejecting the magenta ink and the ejection openings 31*c*1 . . . 31*cn* for ejecting the cyan ink are arranged in alignment. The ejection opening 31 of the row of the ejection openings 27*c* has the same construction as the ejection opening 30. The size of the ejection opening 31 is smaller than that of the ejection opening 30 and is 17×17 $\mu m^2$. The size of the corresponding heater is 24×26 $\mu m^2$, and ejection amount is $4\times10^{-15}$ $m^3$ (4 pl). rows of the ejection openings in the shown embodiment is 42.3 $\mu$m to enable pixel formation corresponding to 600 dpi of printing density. The arrangement pitch may be appropriately determined for desired image formation. Although two rows of the ejection openings are formed in the shown embodiment, it is also possible to arrange a greater number of rows of ejection openings. For example, four rows of ejection openings may be formed for each color of cyan, magenta, yellow and black.

Since sizes of the ejection openings differ in the row of ejection openings 27*b* and the row of ejection openings 27*c*, flow resistances in the ejection openings are also different. To satisfactorily perform ink suction for the respective kinds of rows of ejection openings with different flow resistances without wasting the ink, the shown embodiment of the recovery mechanism has the following construction.

Figure 4:
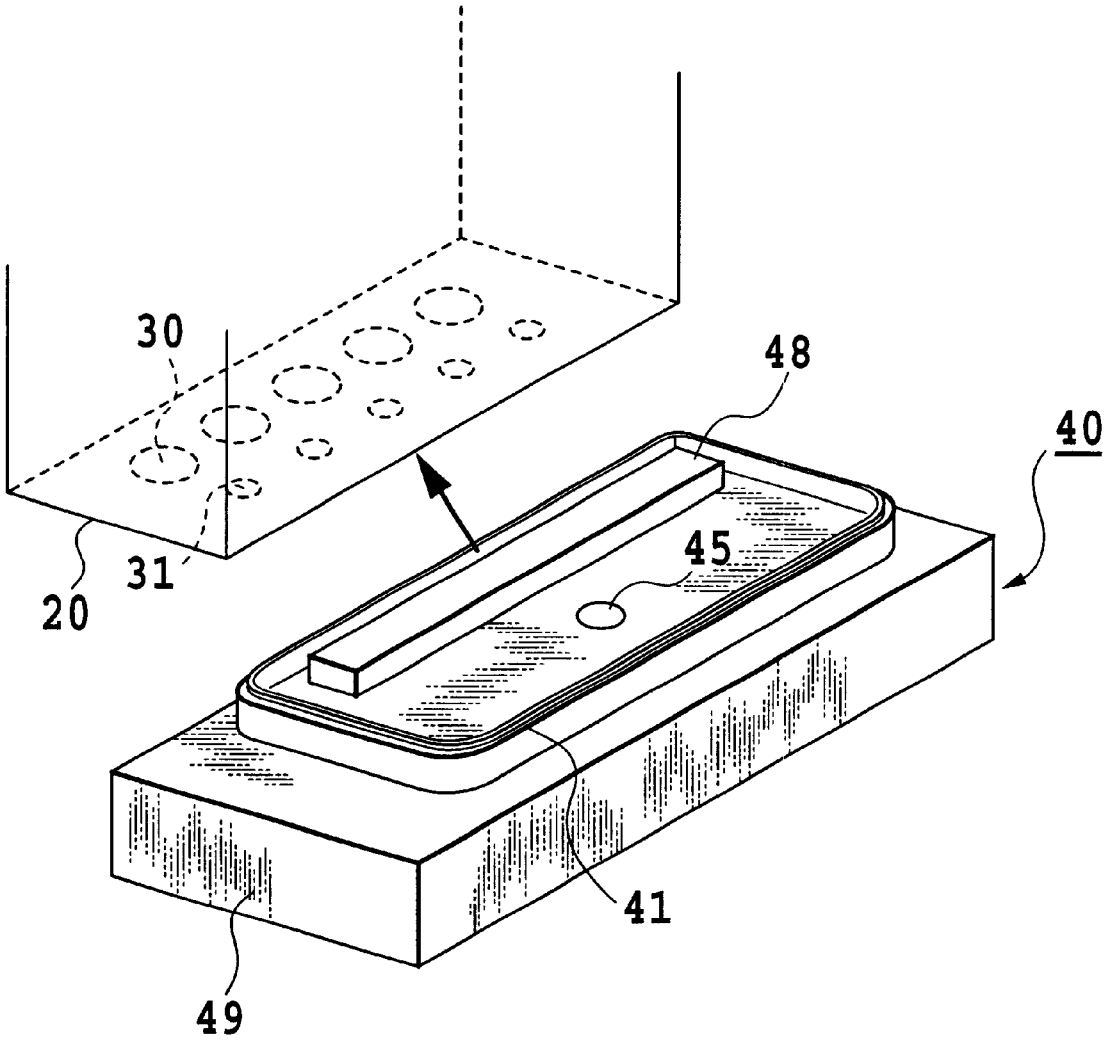
FIG. 4 is a perspective view of a cap.

FIG. 4 is a perspective view of the cap.

The cap 40 comprises a lip portion 41 projecting from the periphery of a base portion 49. Upon contacting the cap 40 onto the ejection opening face 20, the lip portion 41 abuts onto the ejection opening face 20. Upon abutting, rows of the ejection openings 27*b* and 27*c* are surrounded by the lip portion 41.

Within the lip portion 41, ink suction opening 45 is provided. The ink suction opening 45 is communicated with a suction pump (not shown). When the suction pump is driven, dust and dirt deposited on the ejection opening or ink having increased viscosity are suctioned through the ink suction opening 45.

Furthermore, adjacent the ink suction opening, projecting portion 48 is provided along the longitudinal direction of the lip portion 41. A height of the projecting portion 48 is substantially the same height as the circumferential lip portion 41.

As the material of the cap 40, an elastic material, such as rubber or the like for effectively providing gas tightness upon abutting the lip portion 41 onto the ejection opening face 20, is used. Furthermore, in the light of wettability of the ink, chlorinated butyl rubber, silicone rubber and like are preferred. It is preferred that the material of the projecting portion 48 is the same as the material of the cap 40.

Figure 5A:
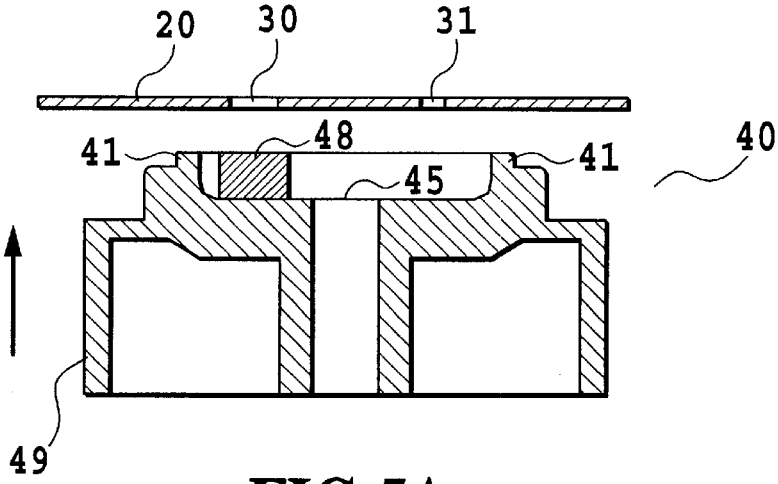
Figure 5B:
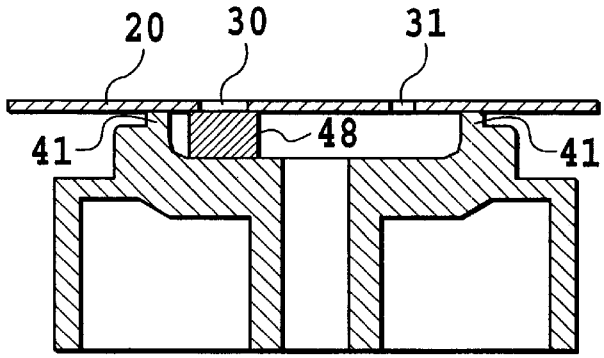
Figure 5C:
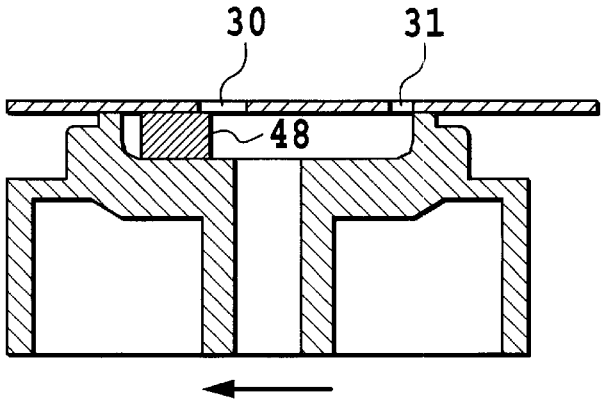

FIGS. 5A to 5C are sections showing states of abutment between the cap and the ejection opening face.

Upon initiation of the recovery process, the carriage is moved so that the printing head is positioned in opposition to the cap. When the printing head reaches the position opposing to the cap, the cap 40 is moved upward as shown in FIG. 5A to abut onto the ejection opening face 20 of the printing head. It should be noted that the printing head is placed at a position where both of the rows of the ejection openings 27*b* and 27*c* are surrounded by the lip portion 41.

When the cap 40 is moved upward and the lip portion 41 abuts onto the ejection opening face 20 of the printing head, the projecting portion 48 having the same height as the lip portion 41, as shown in FIG. 5B, contacts with the ejection openings 30 to seal the ejection openings 30.

Since each ejection opening 30 has a greater opening area than that of each ejection opening 31, each ejection opening 30 has a smaller flow resistance than the ejection opening 31 upon suction of the ink. Therefore, if the pump is driven in a condition in which ejection openings 30 and ejection openings 31 are open without sealing the ejection openings 30 with the projecting portion 48, ink is mainly suctioned from the ejection openings 30 having smaller flow resistance, and suctioning ink from the ejection openings 31 is difficult. However, when suction is performed after sealing the ejection openings 30 having low flow resistance, the ink is suctioned from the ejection openings 31 and ink is not suctioned from the ejection openings 30. In the shown embodiment, the suction operation in the condition shown in FIG. 5B is referred to as the first recovery stage. In the first recovery stage, the ejection openings having small flow resistance and large ejection amount are selectively sealed to allow the suction process for the remaining ejection openings that are not sealed.

When the suction process of the ejection openings 31 is satisfactorily performed, the cap 40 is moved downwardly away from the printing head and is laterally moved parallel to the arrangement direction of the rows of the ejection openings 27*b* and 27*c* by a predetermined amount (direction shown by the arrow in FIG. 5C). Then, the cap 40 is again moved upward to contact with the ejection opening face 20. At this time, as shown in FIG. 5C, the projecting portion 48 contacts at a position not to seal the ejection openings 30. Namely, the cap 40 is abutted in the condition where all of the ejection openings 30 and 31 are sealed. By performing suction by driving the suction pump in this condition, ink is mainly suctioned from the ejection openings 30 that were sealed in the first recovery stage. This is referred to as the second recovery stage.

As set forth above, by performing suction while sealing the ejection openings 30 having low flow resistance in the first recovery stage, and by performing suction after removing the seal of the ejection openings 30 in the second recovery stage, ink suction in just proportion can be performed for respective ejection openings. Namely, with one cap, suction for a plurality of kinds of ejection openings can be performed in just proportion.

In the shown embodiment, after completion of the first recovery stage and in transition to the second recovery stage, the cap 40 is moved down and moved laterally for the predetermined amount in the direction shown by the horizontal arrow, and then is moved upward again to contact with the ejection opening face 20 to place the projecting portion 48 out of contact with the ejection openings 30. However, it is also possible that, after lowering the cap 40, the printing head is moved by the predetermined amount in a lateral direction opposite to the direction of the horizontal arrow and stopped, and then the cap 40 is elevated to contact with the printing head.

Second Embodiment

In the shown embodiment, explanation will be given for the structure of the lip portion of the cap different from the first embodiment.

Figure 6A:
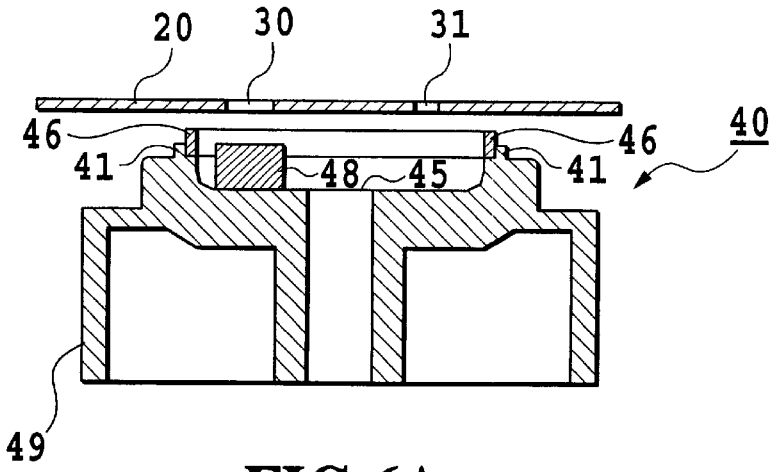
Figure 6B:
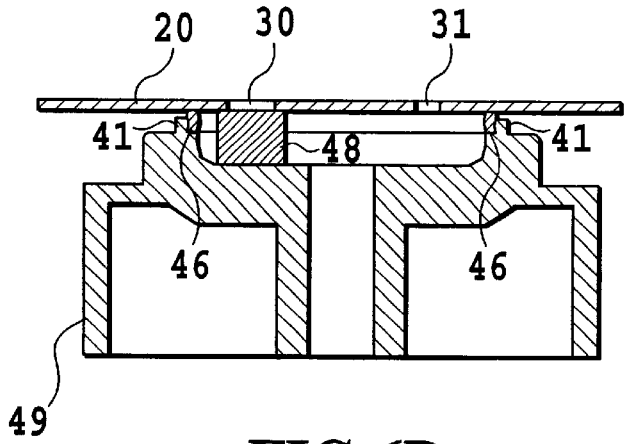
Figure 6C:
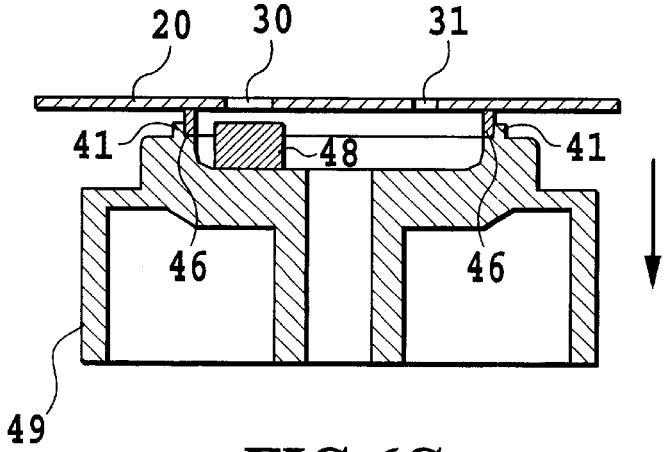

FIGS. 6A to 6C are sections showing the cap and the printing head ejection opening face.

As shown in FIG. 6A, the shown embodiment of the cap 40 is further provided with projection 46 at the tip end of the lip portion 41. The projection 46 is located at a position higher than the projecting portion 48. The projection 46 is formed with a material softer than the lip member 41 that is formed with an elastic material.

Similar to the first embodiment, when the recovery process is initiated, the carriage is moved to the position where the printing head opposes the cap. When the printing head reaches the position opposing the cap, the cap 40 is elevated to contact with the ejection opening face 20 of the printing head. Contacting is performed at the position where the lip portion 41 surrounds all of the ejection openings 30 and 31.

Then, at the first recovery stage, the projection 46 provided at the tip end of the lip portion 41 contacts the ejection opening face 20. Even after contacting the projection 46 onto the ejection opening face 20, the cap 40 is further elevated. As shown in FIG. 6B, by further upward movement of the cap 40, the projection 46 is collapsed by elastic deformation to be bent toward the lip portion 41. When the projection 46 is collapsed, the projecting portion 48 contacts with the ejection opening face 20 to seal the ejection openings 30. By operating the suction pump in this condition, the ink is suctiioned from the ejection openings 31 which are not sealed.

After completion of the suction operation in the first recovery stage, the cap 40 is lowered by a predetermined amount. The magnitude of lowering of the cap 40 is to the extent to slightly weaken the contact force with the ejection opening face 20. Furthermore, as shown in FIG. 6C, the collapsed projection 46 is restored to its original shape still in contact with the ejection opening face 20. Furthermore, by lowering the cap 40, the projecting portion 48 that had sealed the ejection openings 30 is released from the ejection openings 30. Since the projection 46 is located at higher position than the projecting portion 48, a gap is formed between the projecting portion 48 and the ejection openings 30. In this condition, when the suction pump is driven, the ink is mainly suctioned from the ejection openings 30 having low flow resistance. It should be noted that the position where the cap 40 is lowered and stopped is where the projection 46 is still in contact with the ejection opening face 20 without collapsing to maintain the inside of the lip portion 40 in an airtight condition.

Thus, by providing the projection 46 having different elastic characteristics at the tip end of the lip portion 41 and deforming the projection 46, ink suction can be performed for a plurality of ejection openings having different flow resistances in just proportion without moving the cap in left and right (lateral) directions. Accordingly, since the cap is not required to move in the direction perpendicular to the arrangement direction of the ejection openings, this embodiment is applicable for an apparatus having no space for such movement. In addition, the drive mechanism can be simplified.

Third Embodiment

Figure 7A:
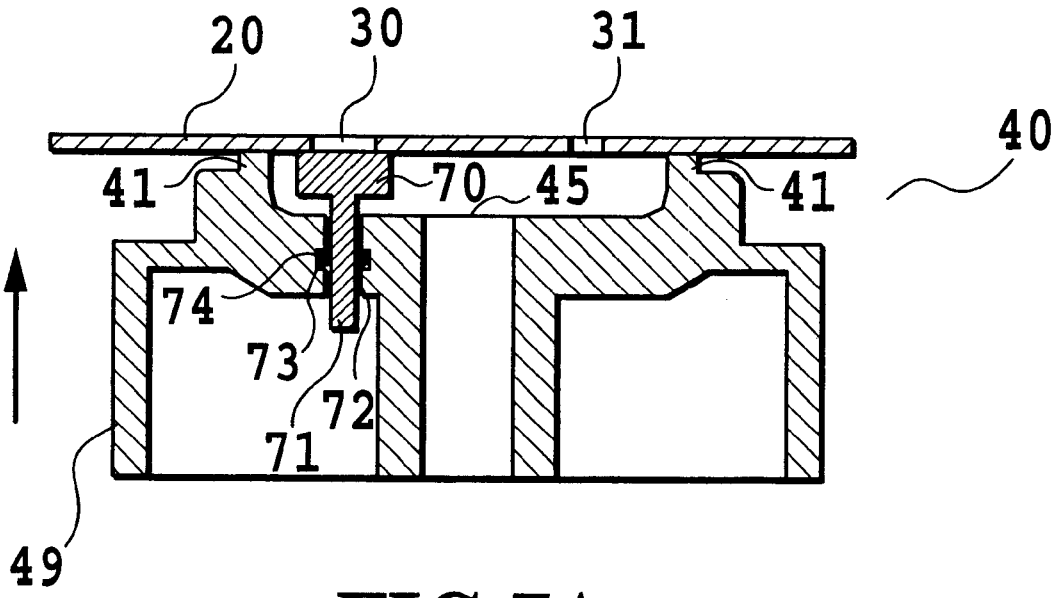
Figure 7B:
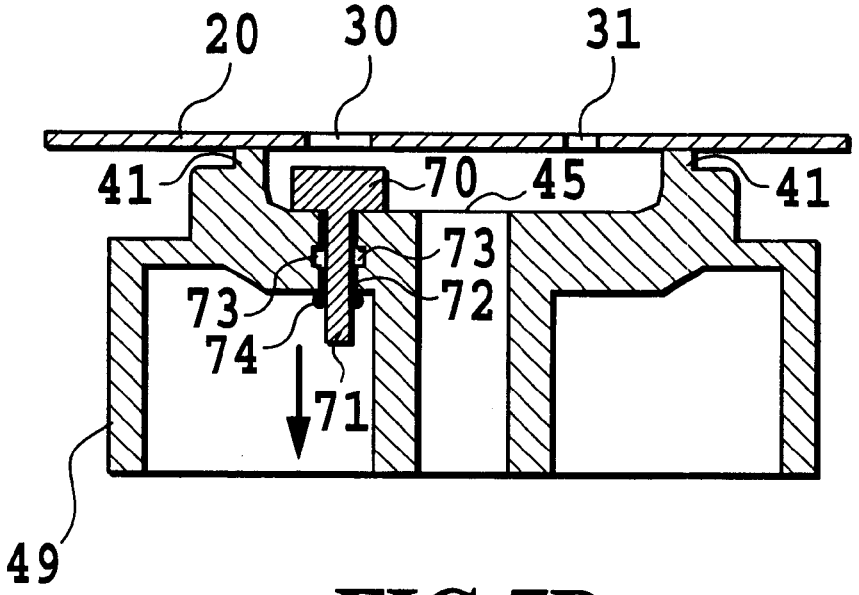
Figure 8A:
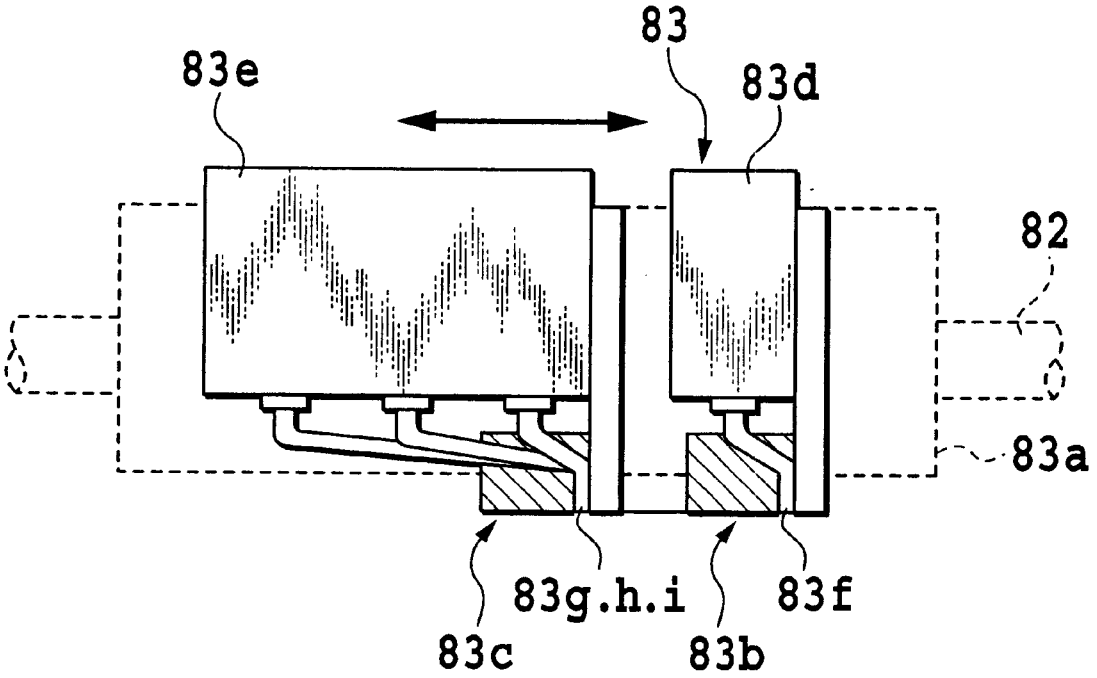
Figure 8B:
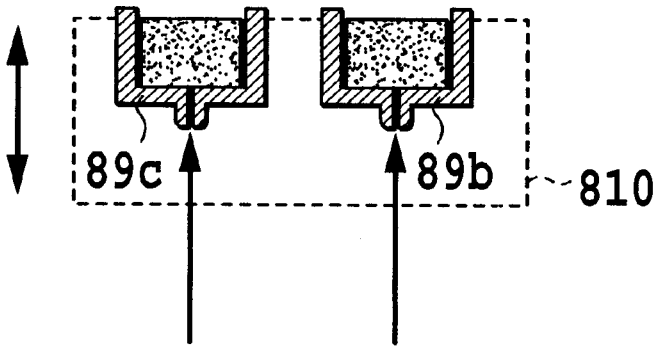

FIGS. 7A and 7B are sections of the shown third embodiment of the cap.

The lip portion 41 of the shown embodiment of the cap 40 is similar to that of the first embodiment. However, as shown in FIG. 7A, a projecting portion 70 is not fixed to the base portion 49 as in the first and second embodiments. Similarly to the first embodiment, the shape of the projecting portion 70 is a rectangular parallelepiped shape elongated in the longitudinal direction of the cap 40 along the rows of the ejection openings. At several portions of the projecting portion 70 on the surface opposing the ejection opening face, support stems 71 are formed integrally. The support stems 71 extend toward the base portion 49 and are inserted into the support holes 72. Furthermore, on a part of each support stem or shaft 71, a ring shaped stopper 74 is provided. On the other hand, in a part of each support hole 72, a recess 73 is provided surrounding the support hole 72.

It should be noted that other portions of the cap 40, such as ink suction opening 45, the base portion 49 and so on are the same as those in the first embodiment. In addition, the ejection openings 30 formed on the ejection opening face 20 have low flow resistance in comparison with the ejection openings 31.

Similarly to the first embodiment, when the recovery process is initiated, at first, the carriage is moved to a position where the printing head opposes the cap. Then, when the printing head reaches the position opposing the cap, the cap 40 is elevated to contact the ejection opening face 20 of the printing head. Contact is performed such that the lip portion 41 surrounds all of the ejection openings 30 and 31.

Then, by not shown driving means, the projecting portion 70 is moved upward to seal the ejection openings 30 (see FIG. 7A). At this time, stopper 74 penetrates into the recess 73. This condition is the first recovery stage. Then, similarly to the first embodiment, the suction pump is driven to perform suction from the ejection openings 31. At this time, with the projection portion 70, the ejection openings 30 are completely sealed. Also, since the stopper 74 enters into the recess 73, an airtight sealing of the gap between the support stem 71 and the support hole 72 is accomplished. By this, the suction force of the suction pump effectively acts on the ejection openings 31.

It should be noted that the driving means of the projecting portion 70 uses, for example, the carriage motor in the ink-jet printing apparatus 1 as its driving source, and can include a cam mechanism driven via a gear. The driving means of the projecting portion 70 may also be formed with an actuator performing reciprocal linear motion, such as plunger type solenoid.

When the suction process from the ejection openings 31 is completed, the projecting portion 70 is lowered by the not shown driving means to release the seal of the ejection openings (see FIG. 7B). This condition is the second recovery stage. Then, similarly as in the first embodiment, the suction pump is driven to suction the ink mainly from the ejection openings 30 having low flow resistance.

Thus, by providing the vertically movable projecting portion 70 within the cap 40, the lip portion 41 of the cap 40 contacts with the ejection opening face 20. Thereafter, the cap 40 per se does not move further to seal the ejection openings having low flow resistance or to release sealing. Accordingly, even in a structure having small space for moving the cap, the recovery process of respective ejection openings can be performed effectively in just proportion.

Other Features

Incidentally, the present invention achieves distinct effects when applied to a print head or a printing apparatus which has means for generating thermal energy, such as electrothermal transducers or lasers, and which causes changes in ink by the thermal energy so as to eject ink. This is because such a system can achieve high density and high resolution printing.

A typical structure and operational principle thereof are disclosed in U.S. Pat. Nos. 4,723,129 and 4,740,796, and it is preferable to use this basic principle to implement such a system. Although this system can be applied either to on-demand type or continuous type inkjet printing systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to generate thermal energy corresponding to printing information; second, the thermal energy induces sudden temperature rise that exceeds the nucleate boiling so as to cause the film boiling on heating portions of the print head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a print head, which is incorporated into the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laid-Open Nos. 59-123670 (1984) and 59-138461 (1984) in order to achieve similar effects. The former discloses a structure in which a slit common to all the electrothermal transducers is used as a common ejection orifice of the electrothermal transducers, and the latter discloses a structure in which openings for absorbing pressure waves caused by thermal energy are formed corresponding to the ejection orifices. Thus, irrespective of the type of the print head, the present invention can achieve printing positively and effectively.

The present invention can be also applied to a so-called full-line type print head whose length equals the maximum length across a printing medium. Such a print head may consist of a plurality of print heads combined together, or one integrally arranged print head.

In addition, the present invention can be applied to various serial type print heads: a print head fixed to the main assembly of a printing apparatus; a conveniently replaceable chip type print head which, when loaded on the main assembly of a printing apparatus, is electrically connected to the main assembly, and is supplied with ink therefrom; and a cartridge type print head integrally including an ink reservoir.

It is further preferable to add a recovery system, or a preliminary auxiliary system for a print head as a constituent of the printing apparatus because they serve to make the effects of the present invention more reliable. Examples of the recovery system are a capping means and a cleaning means for the print head, and a pressure or suction means for the print head. Examples of the preliminary auxiliary system are a preliminary heating means utilizing electrothermal transducers or a combination of other heater elements and the electrothermal transducers, and means for carrying out preliminary ejection of ink independently of the ejection for printing. These systems are effective for reliable printing.

The number and type of print heads to be mounted on a printing apparatus can be also changed. For example, only one print head corresponding to a single color ink, or a plurality of print heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing.

Furthermore, although the above-described embodiments use liquid ink, inks that become liquid when the printing signal is applied can be used: for example, inks can be employed that solidify at a temperature lower than room temperature and are softened or liquefied at room temperature. This is because in the inkjet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the printing medium, thereby preventing the ink evaporation: the ink is transformed from solid to liquid state by positively utilizing the thermal energy which would otherwise cause a temperature rise; or the ink, which is dry when left in air, is liquefied in response to the thermal energy of the printing signal. In such cases, the ink may be retained in recesses or through-holes formed in a porous sheet as liquid or solid substances so that the ink faces the electrothermal transducers as described in Japanese Patent Application Laid-Open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

By employing the present invention, upon covering the ejection opening face with the cap at the predetermined position, the projecting portion is contacted with the predetermined row of the ejection openings, such as the ejection openings having low flow resistance, to seal the predetermined row of the ejection openings. By performing suction in this condition, ink is suctiioned from the row of the ejection openings other than the predetermined row of ejection openings. Then, after sufficiently suctioning the ink from the row of ejection openings other than the predetermined row of ejection openings, the cap is moved to release sealing by the projecting portion to effect suctioning. Then, ink is suctioned from the predetermined row of ejection openings. Thus, ink can be suctioned from all of the ejection openings in just proportion. Therefore, a satisfactory recovery process can be performed for all of the ejection openings having different flow resistances and a compact ink-jet printing apparatus and ejection recovery method can be provided.

Also, by further providing the modified lip portion to the lip portion of the cap, the seal by the projecting portion can be released by merely weakening the contact force to be exerted on the cap without moving the cap in parallel to the ejection opening surface after the first recovery stage is completed, so that it becomes applicable for the apparatus having no space to move the cap. Also, the cap drive mechanism can be simplified.

Also, by providing the mechanism for driving only the projecting portion, once the cap abuts on the ejection opening, the first recovery stage and the second recovery stage can be performed without moving the cap, thus achieving space saving.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. An ink-jet printing apparatus including a printing head having a plurality of ejection openings and a cap for covering an ejection opening face provided with said plurality of ejection openings of said printing head, and suction means for suctioning ink from said ejection openings covered by said cap, comprising:

a sealing member provided within said cap and for sealing a portion of said plurality of ejection openings, wherein when said portion of said plurality of ejection openings are sealed by said sealing member, said suction means suctions ink from ejection openings not sealed by said sealing member.

2. The ink-jet printing apparatus as claimed in claim 1, wherein said suction means selectively performs an operation for suctioning ink after sealing said portion of said plurality of ejection openings by said sealing member and an operation for suctioning ink without sealing said portion of said plurality of ejection openings by said sealing member.

3. The ink-jet printing apparatus as claimed in claim 1 or 2, wherein said plurality of ejection openings include ejection openings having relatively smaller ink flow resistance and ejection openings having relatively larger ink flow resistance, and said portion of said plurality of ejection openings to be sealed by said sealing member are those having the relatively smaller ink flow resistance.

4. The ink-jet printing apparatus as claimed in claim 1 or 2, wherein said plurality ejection openings include ejection openings having a relatively greater ink ejection amount in one ejection operation and ejection openings having a relatively smaller ink ejection amount in one ejection operation, and said portion of said plurality of ejection openings to be sealed by said sealing member are those having the relatively greater ink ejection amount in one ejection operation.

5. The ink-jet printing apparatus as claimed in claim 1 or 2, wherein a plurality of rows of plural ejection openings are arranged on said ejection opening face, and said sealing member, including a projecting portion of a size capable of sealing predetermined rows of ejection openings when said cap covers said ejection opening face, seals said predetermined rows of ejection openings by contacting said predetermined rows of ejection openings with said projecting portion.

6. The ink-jet printing apparatus as claimed in claim 1, wherein said printing head generates a bubble in the ink by thermal energy and ejects the ink in a form of a droplet based on generation of the bubble.

7. An ink-jet printing apparatus having a cap for covering an ejection opening face provided with a plurality of ejection openings of a printing head, wherein said cap comprises:

a projecting lip portion surrounding said plurality of ejection openings when said cap covers said ejection opening face; and a projecting portion formed inside of and surrounded by said lip portion for sealing a portion of said plurality of ejection openings, and wherein when said lip portion contacts with said ejection opening face at a predetermined position, said projecting portion seals said portion of said plurality of ejection openings, and when said cap moves in a direction parallel to said ejection opening face to contact with said ejection opening face at a position different from said predetermined position, said projecting portion does not seal said portion of said plurality of ejection openings.

8. An ink-jet printing apparatus having a cap for covering an ejection opening face provided with a plurality of ejection openings of a printing head, wherein said cap comprises:

a projecting lip portion surrounding said plurality of ejection openings when said cap covers said ejection opening face;

a deformable lip portion formed at a projecting tip end of said projecting lip portion; and a projecting portion formed inside of and surrounded by said projecting lip portion for sealing a portion of said plurality of ejection openings, and wherein when said projecting lip portion is applied with a predetermined contact force at a predetermined position to contact with said ejection opening face, said deformable lip portion is deformed and said projecting portion seals said portion of said plurality of ejection openings, and when said projecting lip portion is applied with a force less than the predetermined contact force at the predetermined position to contact with said ejection opening face, said deformable lip portion is not deformed and said projecting portion does not seal said portion of said plurality of ejection openings.

9. The ink-jet printing apparatus as claimed in claim 8, wherein said projecting lip portion and said deformable lip portion are formed of an elastic material, with said deformable lip portion having a higher elastic modulus than that of said projecting lip portion.

10. An ink-jet printing apparatus having a cap for covering an ejection opening face provided with a plurality of ejection openings of a printing head, wherein said cap comprises:

a projecting lip portion surrounding said plurality of ejection openings when said cap covers said ejection opening face;

a projecting portion formed inside of and surrounded by said lip portion for sealing a portion of said plurality of ejection openings; and a projecting portion actuating portion for moving said projecting portion for sealing said portion of said plurality of ejection openings when a suction operation of the ejection openings other than said portion of said plurality of ejection openings is performed, and for moving said projecting portion for releasing the seal of said portion of said plurality of ejection openings while a suction process of said portion of said plurality of ejection openings is performed.

11. An ejection recovery processing method of an ejection port comprising:

a covering step of covering an ejection opening face provided with a plurality of ejection openings with a cap;

a sealing step of sealing a portion of said plurality of ejection openings with a sealing member provided within said cap; and a suction step of suctioning ink from ejection openings not sealed by said sealing member in said sealing step.

12. The recovery processing method of an ejection port as claimed in claim 11, wherein said plurality of ejection openings include ejection openings having relatively smaller ink flow resistance and ejection openings having relatively larger ink flow resistance, and said portion of said plurality of ejection openings to be sealed in said sealing step are those having the relatively smaller ink flow resistance.

13. The recovery processing method of an ejection port as claimed in claim 11, wherein said plurality ejection openings include ejection openings having a relatively greater ink ejection amount in one ejection operation and ejection openings having a relatively smaller ink ejection amount in one ejection operation, and said portion of said plurality of ejection openings to be sealed in said sealing step are those having the relatively greater ink ejection amount in one ejection operation.

14. The recovery processing method of an ejection port as claimed in claim 11, wherein a plurality of rows of plural ejection openings are arranged on said ejection opening face, and in said sealing step, when said cap covers said ejection opening face, a projecting portion of a size capable of sealing predetermined rows of ejection openings is contacted with said predetermined rows of ejection openings to seal said predetermined rows of ejection openings.

* * * * *

UNITED STATES PATENT AND TRADEMARK OFFICE

CERTIFICATE OF CORRECTION

PATENT NO. : 6,508,533 B2
DATED : January 21, 2003
INVENTOR(S) : Tsujimoto et al.

It is certified that error appears in the above-identified patent and that said Letters Patent is hereby corrected as shown below:

Title page,
Item [*] Notice, “42 days.” should read -- 0 days. --.

Column 2,
Lines 57 and 58, should be merged into the same paragraph.

Column 3,
Line 60, “the of” should read -- the portion of --.

Column 5,
Lines 18 and 19, should be merged into the same paragraph.

Column 6,
Line 13, “election” should read -- ejection --.
Line 57, ‘pl). rows” should read -- pl). It should be noted that the arrangement pitch of the rows --.

Column 8,
Line 64, “suctiioned” should read -- suctioned --.

Column 12,
Line 24, “suctiioned” should read -- suctioned --.

Column 13,
Line 19, “plurality” should read -- plurality of --.

UNITED STATES PATENT AND TRADEMARK OFFICE

CERTIFICATE OF CORRECTION

PATENT NO. : 6,508,533 B2
DATED : January 21, 2003
INVENTOR(S) : Tsujimoto et al.

It is certified that error appears in the above-identified patent and that said Letters Patent is hereby corrected as shown below:

Column 14,
Line 59, "plurality" should read -- plurality of --.

Signed and Sealed this

Eighth Day of June, 2004

JON W. DUDAS
*Acting Director of the United States Patent and Trademark Office*